United States Patent [19]

Knowlton

[11] Patent Number: 4,974,858

[45] Date of Patent: Dec. 4, 1990

[54] TOSSING GAME

[76] Inventor: Kenneth R. Knowlton, 8250 Harris Rd., Millington, Mich. 48746

[21] Appl. No.: 427,570

[22] Filed: Oct. 27, 1989

[51] Int. Cl.[5] ..... A63B 67/06

[52] U.S. Cl. ..... 273/401; 273/402

[58] Field of Search ..... 273/398, 400, 401, 402, 273/424, 425, 336, 338

[56] References Cited

U.S. PATENT DOCUMENTS

| | | | |
|---|---|---|---|
| 2,126,245 | 8/1938 | Darby | 273/425 |
| 4,203,592 | 5/1980 | Quatkemeyer | 273/336 |
| 4,204,682 | 5/1980 | Brown | 273/401 |
| 4,243,229 | 1/1981 | Huser et al. | 273/402 |

*Primary Examiner*—William H. Grieb
*Attorney, Agent, or Firm*—Leon Gilden

[57] ABSTRACT

A tossing game which may be utilized indoors or outdoors and which is similar to horseshoes includes the use of two boards which are positionable in spaced apart vertical alignment. Players stand behind a particular board and throw washers into holes located in the opposed board. In the preferred embodiment, three holes are positioned in each board and are given different score ratings. The two identical wood boards may be covered with a soft material, such as carpeting, to prevent the washers from bouncing when thrown. In a second embodiment, grooves are provided between the holes. The grooves permit washers to be tossed and rolled on their edges into a particular aperture.

2 Claims, 4 Drawing Sheets

TOSSING GAME

BACKGROUND OF THE INVENTION

1. Field of the Invention

The present invention relates to the field of games, and in particular to a new and improved tossing game which may be utilized either indoors or outdoors.

2. Description of the Prior Art

Tossing games are well known in the prior art. They reflect the fact that these fundamentally simple games have a wide base of appeal and understanding among those individuals who play the games. The basic concept of such tossing games is well reflected in the patent art. For example, U.S. Pat. No. 2,126,245, which issued to W. A. Darby on Aug. 9, 1938, discloses the use of a disk-like projectile which is designed to be tossed through the air into a bag or collapsible basket that functions as a goal. More recently, U.S. Pat. No. 4,204,682, which issued to F. Brown on May 27, 1980, illustrates a method of playing a game that employs the use of washer-shaped projectiles designed to be tossed into cylindrically-shaped receptacles positioned in the ground. These patents are but illustrative of numerous others which rely upon the tossing game concept, and they also illustrate the fact that minor improvements to the basic tossing game concept reflects patentable improvement as evidenced by user interest and enjoyment.

While both the Darby and Brown games can be utilized either indoors or outdoors, it can be appreciated that there is a continuing need for portable tossing game constructions which offer some variation in the manner of playing. In this respect, the present invention substantially fulfills this need.

SUMMARY OF THE INVENTION

In view of the foregoing differences inherent in the known types of portable tossing games now present in the prior art, the present invention provides an improved portable tossing game construction wherein the same can be utilized either indoors or outdoors and which offers the variation of either tossing or rolling the projectiles utilized therewith. As such, the general purpose of the present invention, which will be described subsequently in greater detail, is to provide a new and improved portable tossing game which has all the advantages of the prior art portable tossing games and none of the disadvantages.

To attain this, the present invention utilizes two boards which are designed to be placed in vertical alignment approximately four feet apart between their closest ends. Players stand behind a particular board and throw projectiles, such as washers, into holes in the opposed board. Each board may be provided with a plurality of aligned holes which reflect different scores depending upon the distance from a player. The identical boards may be covered with a soft material, such as carpeting or the like, to prevent the washers from bouncing too much when the land on the board. Additionally, grooves may be provided in the boards between the scoring holes so that washers may also be tossed and subsequently rolled within a groove so as to fall into one of the scoring apertures.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable tossing game which has all the advantages of the prior art portable tossing games and none of the disadvantages.

It is another object of the present invention to provide a new and improved portable tossing game which may be easily and efficiently manufactured and marketed.

It is a further object of the present invention to provide a new and improved portable tossing game which is of a durable and reliable construction.

An even further object of the present invention is to provide a new and improved portable tossing game which is susceptible of a low cost of manufacture with regard to both materials and labor, and which accordingly is then susceptible of low prices of sale to the consuming public, thereby making such portable tossing games economically available to the buying public.

Still yet another object of the present invention is to provide a new and improved portable tossing game which provides in the apparatuses and methods of the prior art some of the advantages thereof, while simultaneously overcoming some of the disadvantages normally associated therewith.

Still another object of the present invention is to provide a new and improved portable tossing game which may be utilized either indoors or outdoors.

Yet another object of the present invention is to provide a new and improved portable tossing game which provides the option of rolling a projectile into a scoring aperture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

With reference now to the drawings, and in particular to FIGS. 1, 2, 3 and 4 thereof, a new and improved portable tossing game embodying the principles and concepts of the present invention will be described.

More specifically, it will be noted that the portable tossing game includes the use of two identical scoring boards 10 having a plurality of aligned scoring holes or apertures 12 positioned therein. The apertures 12 may be drilled partially or completely through a particular scoring board 10 and are designed to receive tossed projectiles such as conventional washers 14. In the preferred embodiment, each scoring board 10 could be conveniently constructed from wood. However, it is within the intent and purview of the present invention to manufacture a particular scoring board 10 from any conceivable material which would accomplish the function and purpose of the invention.

Figure 1:
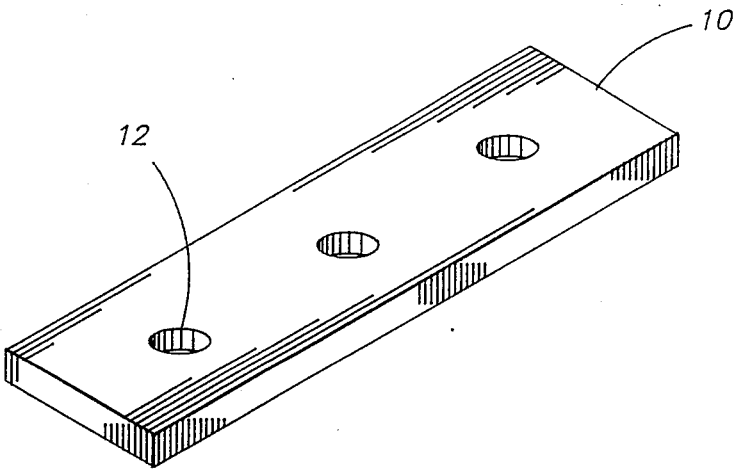
FIG. 1 is a perspective view of a scoring board forming a part of the present invention.
Figure 2:
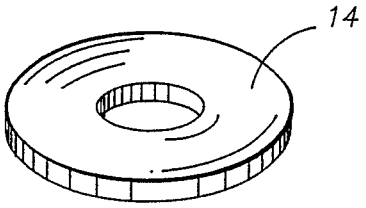
FIG. 2 is a perspective view of a projectile forming a part of the invention.
Figure 3:
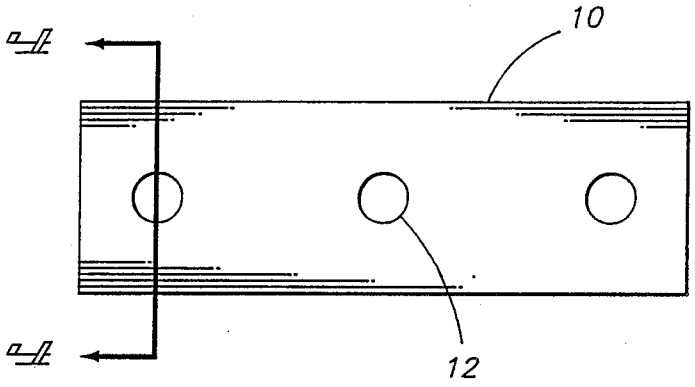
FIG. 3 is a top plan view of a scoring board.
Figure 4:
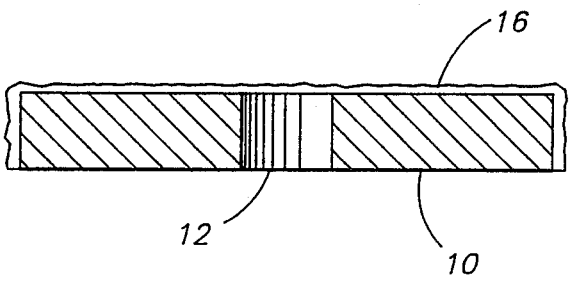
FIG. 4 is a cross-sectional view of a scoring board as viewed along the line 4—4 shown in FIG. 3.

As best illustrated in FIG. 4, each scoring board 10 could be conveniently covered with a soft padding, such as carpeting 16. As can be appreciated, the soft padding 16 would prevent projectiles 14 from bouncing too much when they strike the scoring board 10. While carpeting 16 represents the preferred covering for the boards 10, any soft padding material could be substituted therefore.

Figure 5:
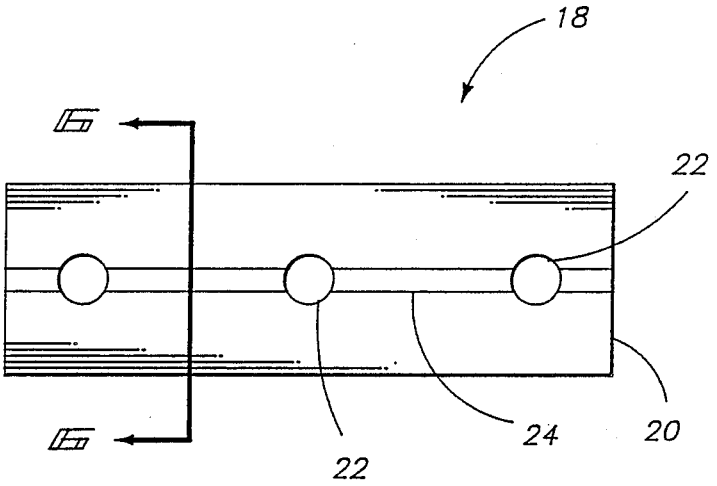
FIG. 5 is a top plan view of a second embodiment of a scoring board.
Figure 6:
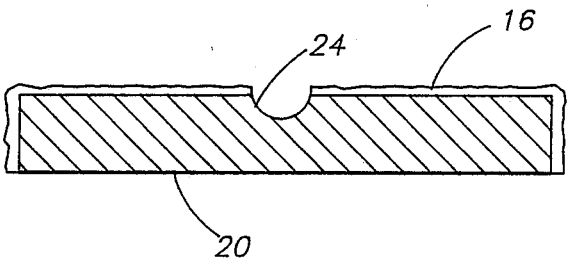
FIG. 6 is a cross-sectional view as viewed along the line 6—6 shown in FIG. 5.

With particular reference to FIGS. 5 and 6, a second embodiment of the invention is shown which is generally designated by the reference numeral 18. More particularly, this embodiment 18 of the invention includes a scoring board 20 having a plurality of aligned apertures 22 which are interconnected by a rounded groove 24 positioned along a top surface of the board 20.

The groove 24 would conveniently extend along a complete length of the scoring board 20 and would interconnect all apertures 22 regardless of their number. While the prior embodiment of the invention utilizing scoring board 10 is deigned primarily to have washers 14 tossed directly into the scoring apertures 12, the board 20 reflected in the second embodiment 18 is designed to additionally have a tossed washer roll on its edge within a groove 24 until the same drops into a scoring aperture 22. In the second embodiment 18 of the invention, the grooves 24 could be milled or otherwise cut into the surface of a scoring board 20 and would not be covered with a padding material 16. In this regard, the padding material 16 as utilized in the first embodiment of the invention would also preferably be utilized on the second embodiment 18.

Figure 7:
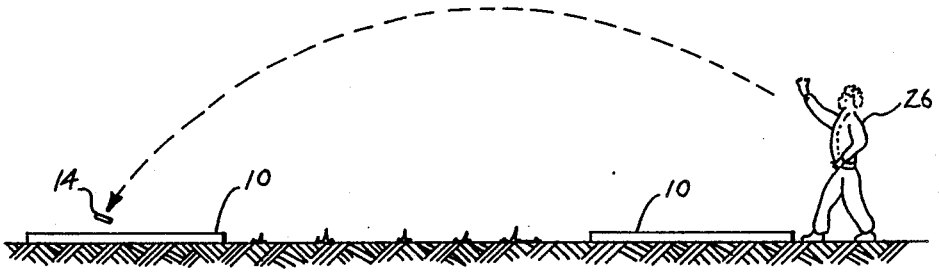
FIG. 7 is a representational view illustrating the manner of play of the game forming the present invention.

The manner of playing the present invention will be described with reference to FIG. 7 of the drawings. In this connection, two scoring boards 10 may be vertically aligned approximately four feet apart at their closest ends. Each scoring board 10 could be of a four foot length with the scoring apertures being positioned approximately one foot apart and in vertical alignment along the board. In the preferred embodiment, the scoring apertures could be approximately four inches in diameter and would number three on each board. With a player 26 being positioned at each opposed end of the boards 10 as shown, the scoring holes could yield one, three and five points from the closest to furthest away respectively. The intent would be for players to reach a score of exactly 21 and any throw that would yield a score over 21 is subtracted from the player's score. As is apparent then, any number of circular flat metal washers 14 could be provided to the players 26, and the game could be played as singles or doubles by players of all ages. While the first embodiment relies upon a player 26 scoring a substantially direct hit with a tossed washer 14, the second embodiment 18 allows a player the option of tossing a washer in a vertical edge manner so as to cause the washer to rollably engage a groove 24 and be guided thereby into a particular scoring aperture 12. In effect, the groove 24 adds an innovative and imaginative quality to the game.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A portable tossing game comprising:

at least one scoring board means for receiving a tossed projectile, said scoring board means having at least one projectile receiving aperture positioned therein;

and at least one projectile for tossing into said at least one projectile receiving aperture, and wherein said tossed projectile comprises a washer, and further including padding means positionable over selected portions of said at least one scoring board means, said padding means serving to cushion a striking force experienced by said tossed projectile, thereby to prevent said tossed projectile from experiencing an extreme bouncing force, and further including projectile guiding means positioned upon a top surface of said at least one scoring board means, and wherein said projectile guiding means comprises a groove for receiving a tossed projectile in a manner which permits said projectile to roll into said at least one projectile receiving aperture, thereby to effect a scoring situation by a player.

2. The new and improved portable tossing game as described in claim 1, wherein said groove is positioned between a plurality of projectile receiving apertures.

* * * * *